US010704803B2

(12) United States Patent
Iskrenovic

(10) Patent No.: US 10,704,803 B2
(45) Date of Patent: Jul. 7, 2020

(54) INFRARED WATER HEATER

(75) Inventor: Zoran Iskrenovic, Nis (RS)

(73) Assignee: Seven International Group, Inc., Sherman Oaks, CA (US)

( * ) Notice: Subject to any disclaimer, the term of this patent is extended or adjusted under 35 U.S.C. 154(b) by 818 days.

(21) Appl. No.: 13/460,059

(22) Filed: Apr. 30, 2012

(65) Prior Publication Data

US 2012/0275775 A1 Nov. 1, 2012

Related U.S. Application Data

(60) Provisional application No. 61/533,706, filed on Sep. 12, 2011, provisional application No. 61/480,317, filed on Apr. 28, 2011.

(51) Int. Cl.

| | |
|---|---|
| ***F24H 1/12*** | (2006.01) |
| ***F24H 1/14*** | (2006.01) |
| ***F24H 1/16*** | (2006.01) |
| ***F24H 9/14*** | (2006.01) |

(52) U.S. Cl.

CPC ..... *F24H 1/142* (2013.01); *F24H 1/162* (2013.01); *F24H 9/14* (2013.01); *F24H 2250/08* (2013.01); *F24H 2250/14* (2013.01)

(58) Field of Classification Search

CPC ..... F24H 1/162; F24H 2250/14; F24H 1/14; H05B 2203/021

USPC ..... 392/481, 483, 484, 480, 496, 482

See application file for complete search history.

(56) References Cited

U.S. PATENT DOCUMENTS

| | | | | |
|---|---|---|---|---|
| 1,376,485 | A * | 5/1921 | Verstraete | 392/481 |
| 1,539,039 | A * | 5/1925 | Blanding | 392/481 |
| 1,620,745 | A * | 3/1927 | Wainwright | 392/481 |
| 1,716,996 | A * | 6/1929 | Adam | 392/481 |
| 1,893,484 | A * | 1/1933 | Belt | 165/160 |
| 1,906,145 | A * | 4/1933 | Evans | 392/481 |
| 1,997,844 | A * | 4/1935 | Wiegand | H05B 3/50 219/540 |
| 2,277,291 | A * | 3/1942 | Blair | A47L 15/00 122/40 |
| 2,791,204 | A * | 5/1957 | Andrus | 122/33 |
| 4,246,871 | A * | 1/1981 | Bocksruker et al. | 122/4 A |
| 4,334,522 | A | 6/1982 | Dukess | |
| 4,510,890 | A | 4/1985 | Cowan | |
| 5,216,215 | A * | 6/1993 | Walker | H05B 6/108 219/630 |
| 5,590,240 | A * | 12/1996 | Rezabek | F24H 1/162 165/184 |
| 5,685,997 | A | 11/1997 | LoPresti | |
| 6,577,817 | B2 * | 6/2003 | Harris | F24H 7/0433 392/479 |
| 6,701,069 | B1 * | 3/2004 | Cezayirli et al. | 392/490 |

(Continued)

FOREIGN PATENT DOCUMENTS

| | | |
|---|---|---|
| EP | 279767 | 12/1992 |
| GB | 2472809 | 2/2011 |

*Primary Examiner* — Dana Ross
*Assistant Examiner* — Lawrence H Samuels
(74) *Attorney, Agent, or Firm* — Umberg Zipser LLP

(57) ABSTRACT

Water heaters are disclosed having first and second fluid conduits, where the second fluid conduit is fluidly coupled to and disposed about at least a portion of the first conduit. One or more heating device, and preferably an infrared light source, can be disposed between the first and second conduits, such that water flowing within the conduits can be heated by the heating device.

17 Claims, 5 Drawing Sheets

(56) References Cited

U.S. PATENT DOCUMENTS

| | | | | |
|---|---|---|---|---|
| 7,173,179 | B2 * | 2/2007 | Nicoletti et al. | 136/246 |
| 2003/0026603 | A1 * | 2/2003 | Castaneda | F24H 1/142<br>392/483 |
| 2003/0216689 | A1 * | 11/2003 | Bouhuijs | A61M 5/44<br>604/113 |
| 2004/0184794 | A1 * | 9/2004 | Johnson | F24H 1/162<br>392/483 |
| 2007/0143914 | A1 * | 6/2007 | Shirai | E03D 9/08<br>4/420.2 |
| 2008/0011336 | A1 * | 1/2008 | Hamaguchi | F24H 1/101<br>134/105 |
| 2010/0192944 | A1 | 8/2010 | Gruber | |
| 2011/0058787 | A1 | 3/2011 | Servidio | |
| 2012/0080422 | A1 * | 4/2012 | Chung | F24D 17/0073<br>219/546 |
| 2013/0026904 | A1 * | 1/2013 | De Santiago | H01K 1/14<br>313/274 |

* cited by examiner

FIG. 1A
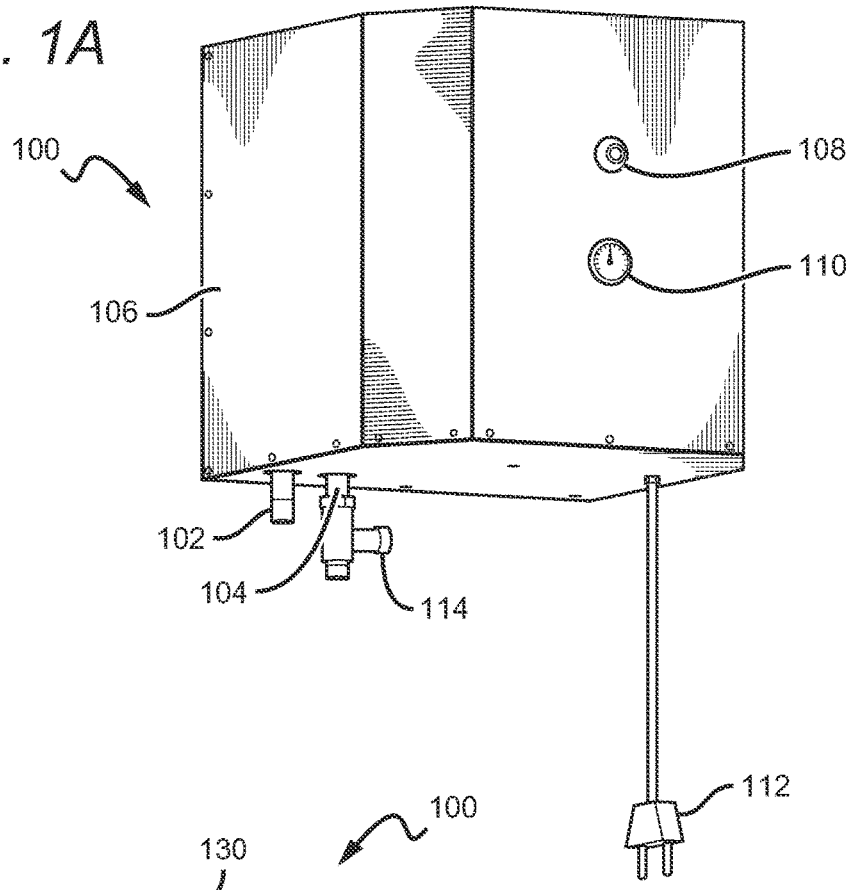
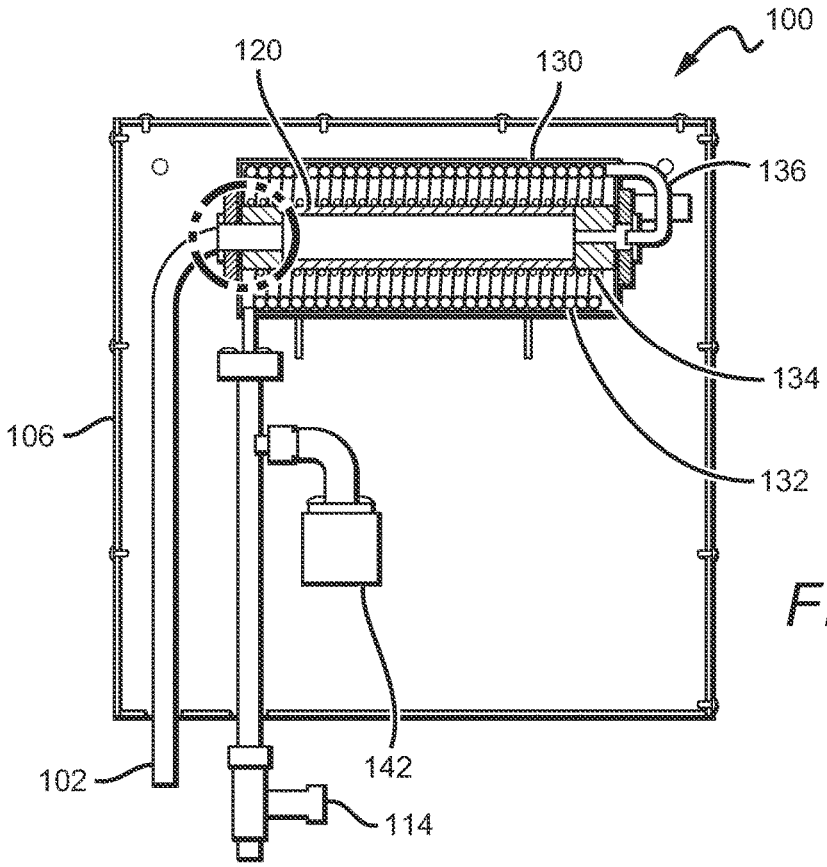
FIG. 1B

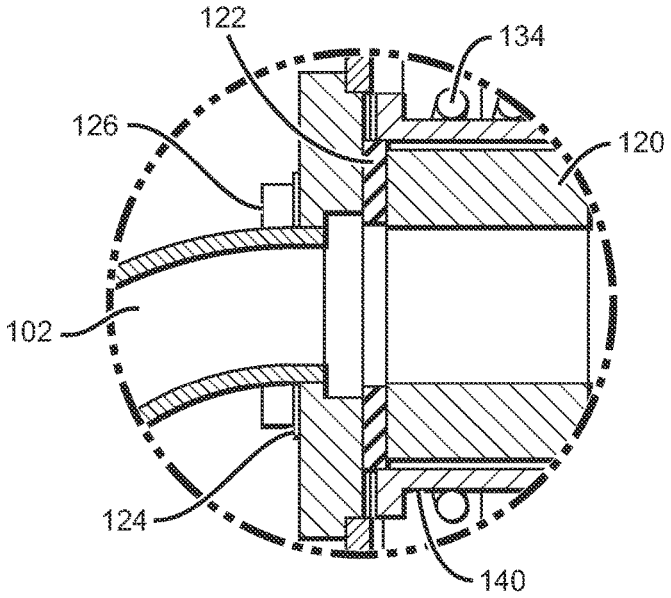
FIG. 1C
FIG. 1D
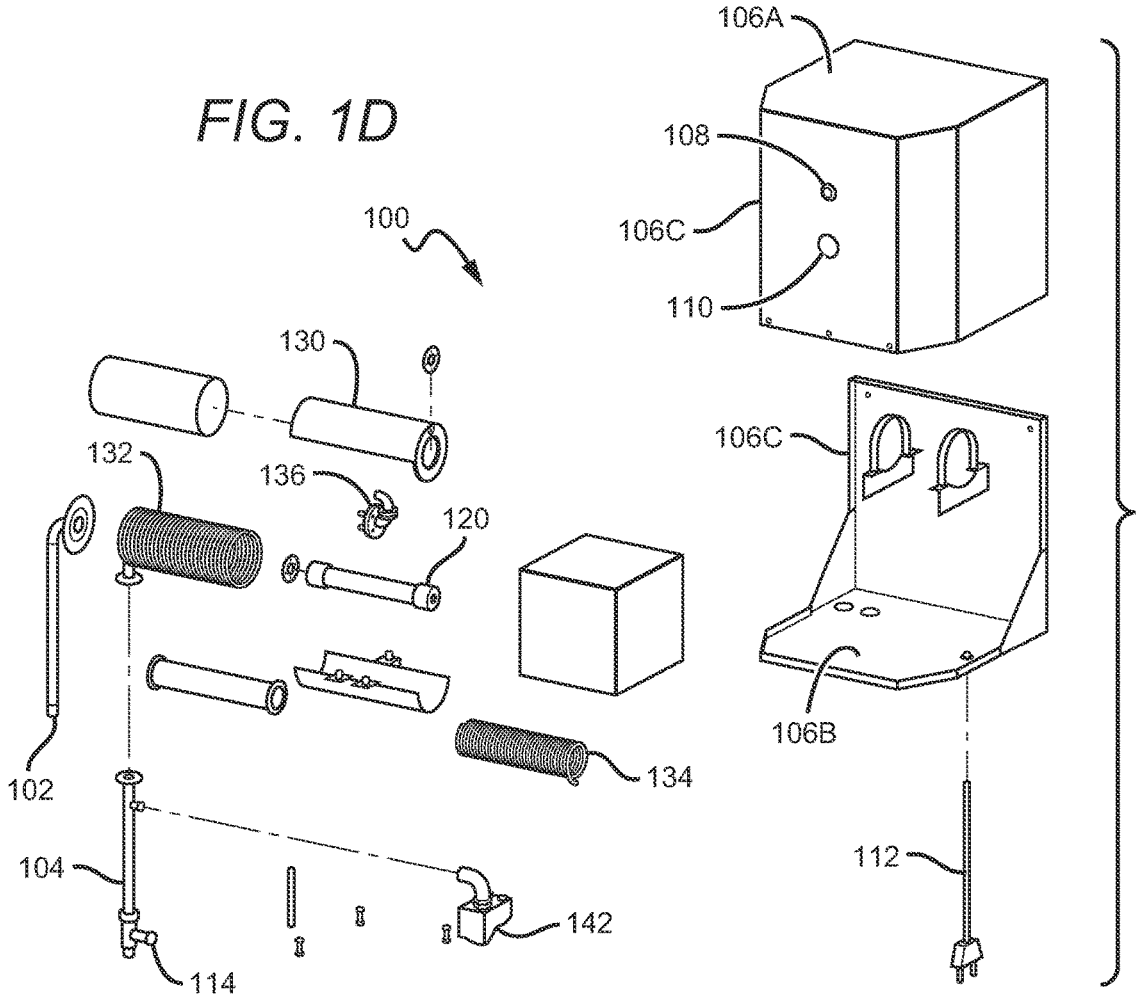

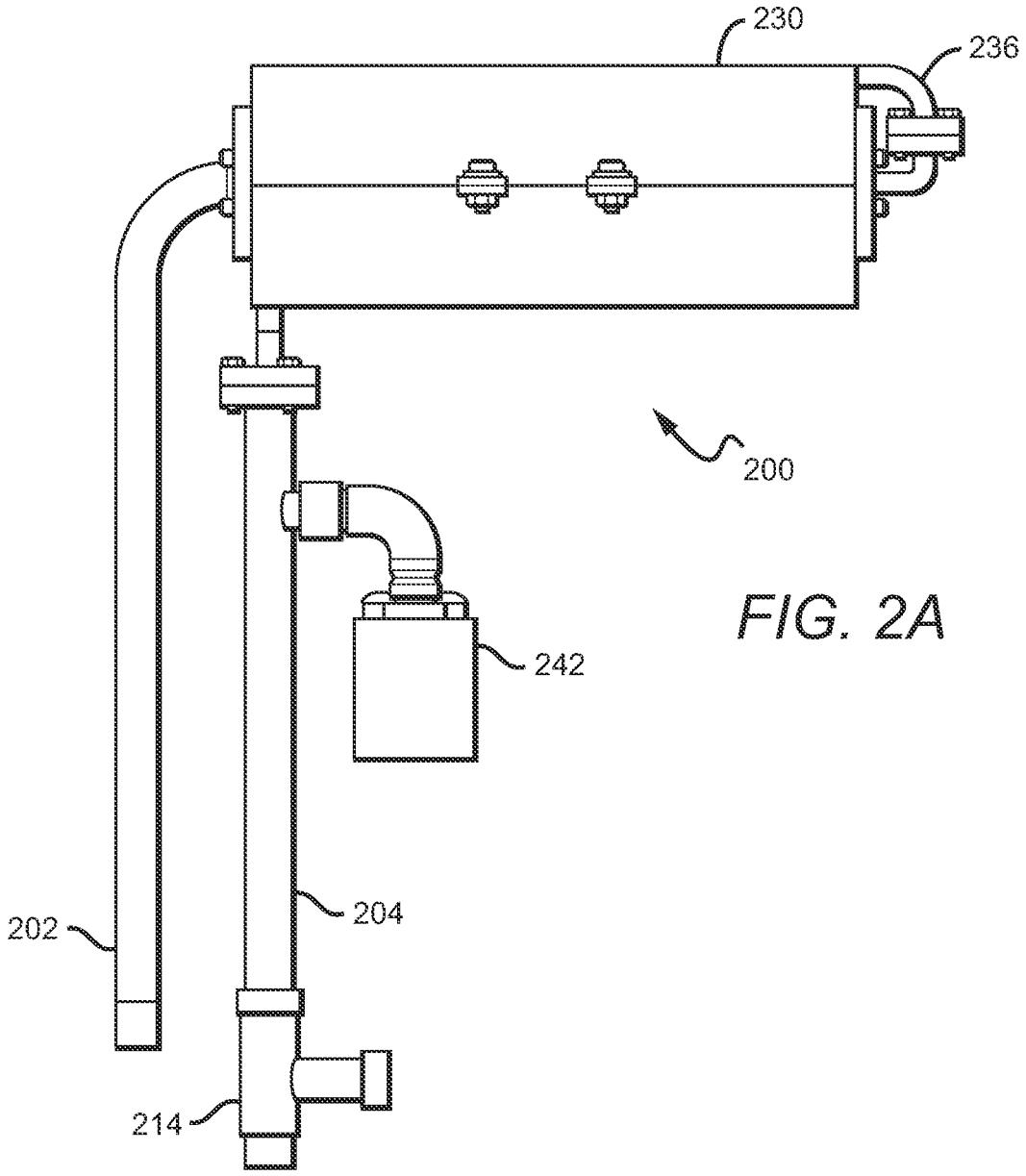
FIG. 2A
FIG. 3
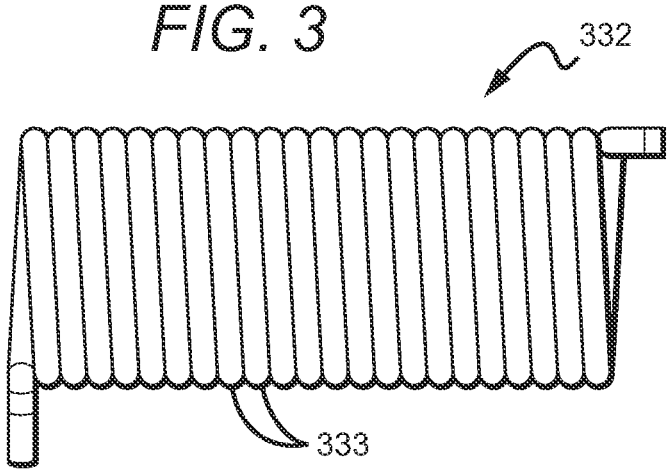

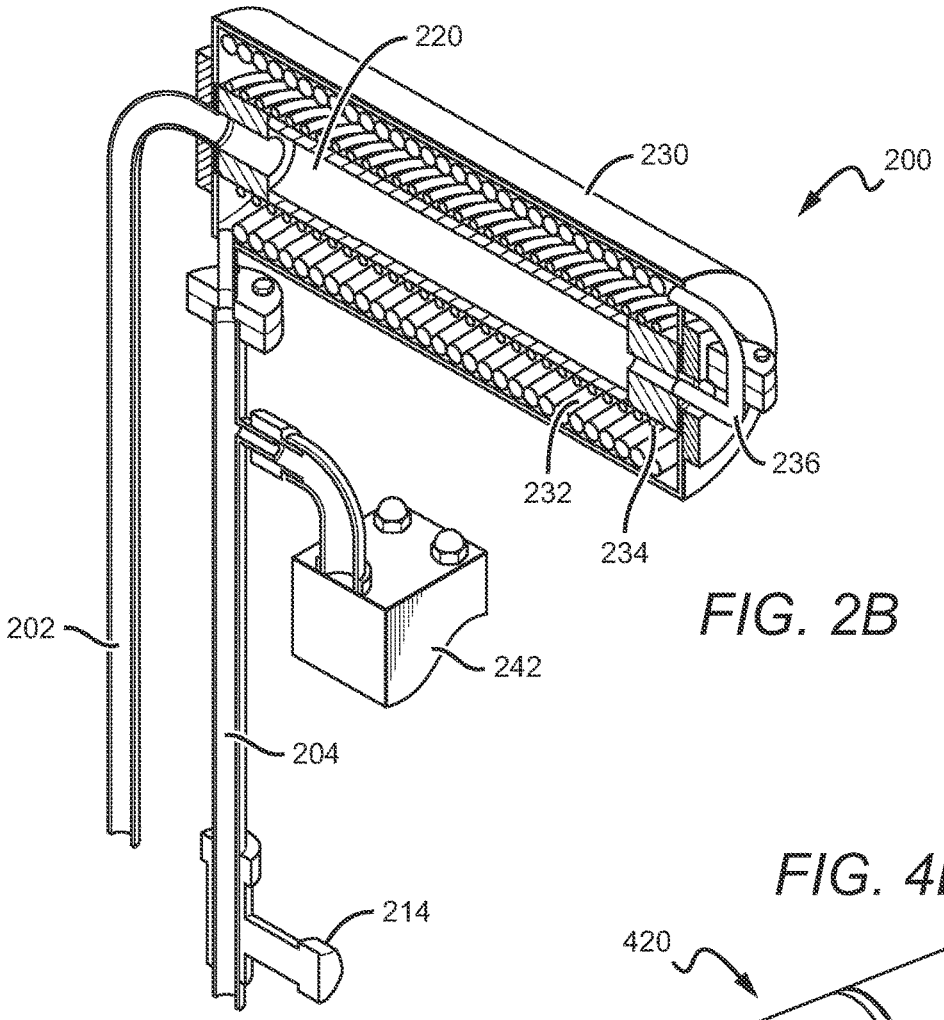
FIG. 2B
FIG. 4B
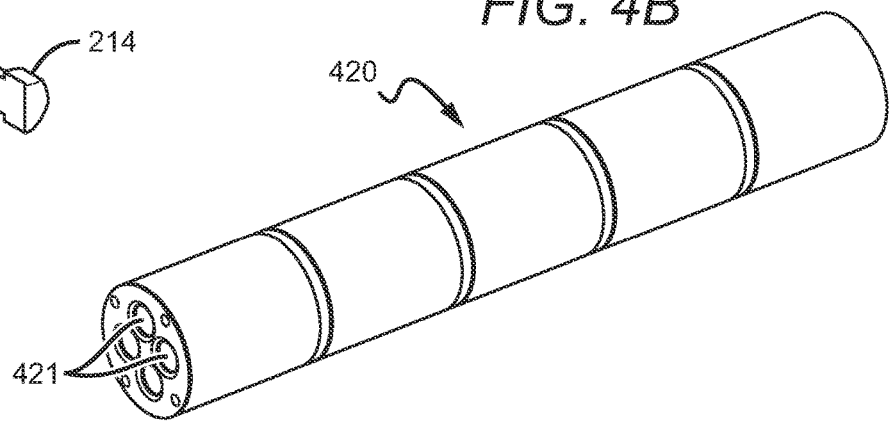
FIG. 4A
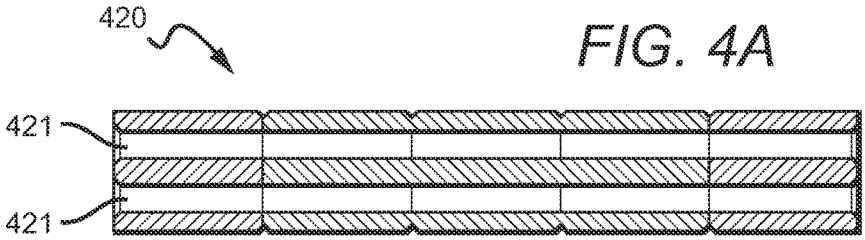

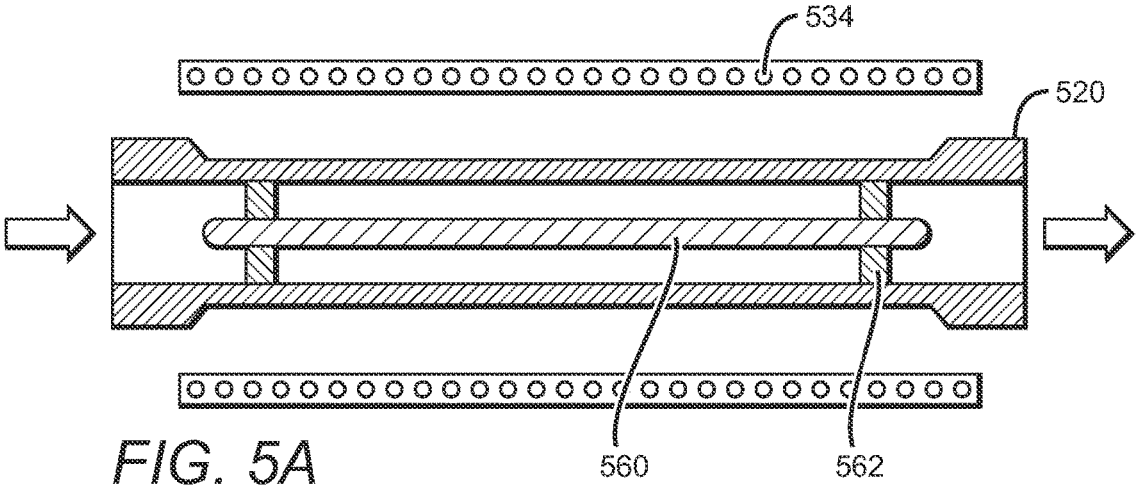
FIG. 5A
FIG. 5B
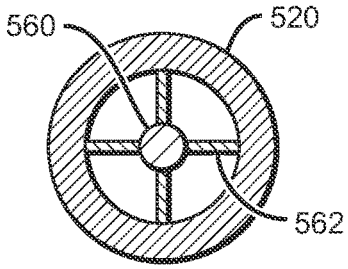
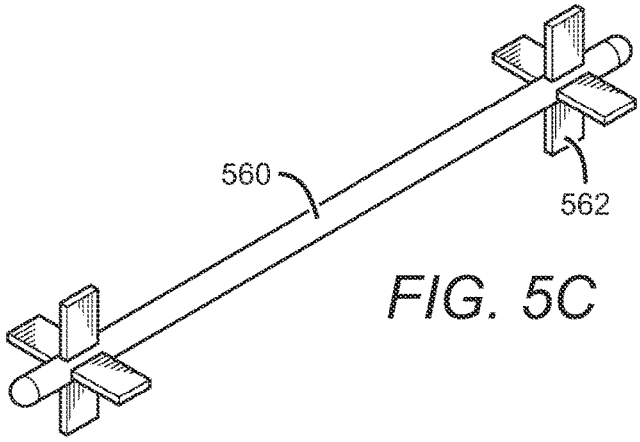
FIG. 5C
FIG. 6
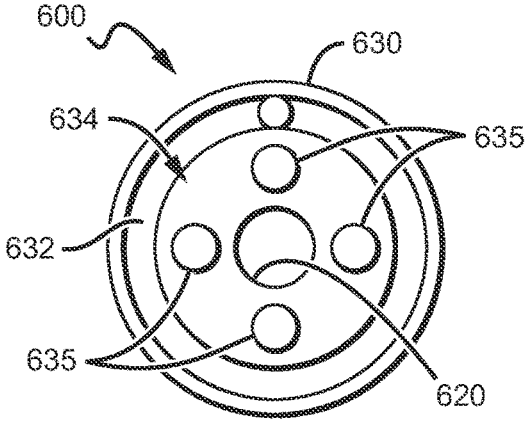
FIG. 7
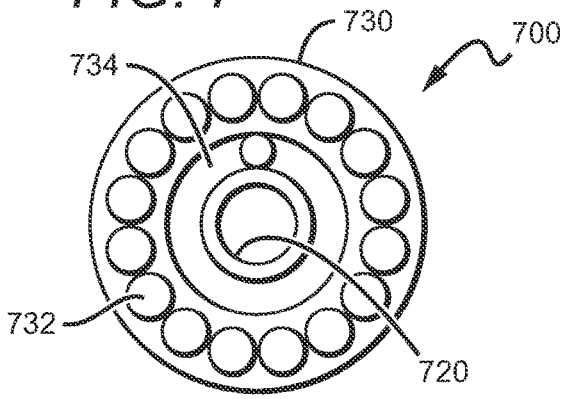

INFRARED WATER HEATER

This application claims the benefit of priority to U.S. provisional application having Ser. No. 61/480,317 filed on Apr. 28, 2011, and U.S. provisional application having Ser. No. 61/533,706 filed on Sep. 12, 2011. These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is water heaters.

BACKGROUND

In the United States, water heaters traditionally have a tank configured to hold a quantity of heated water. Tanked water heaters are advantageous in that they can provide a relatively large volume of hot water from a relatively tow level energy source, but they are inefficient in that they maintain a supply of hot water even when such water is not being used. Such water heaters are also problematic in that they can therefore "run out of hot water" from time to time. Still further such traditional tank heaters can pose a danger of explosion if the relief valve fails due to limestone, calcium or other deposits.

One solution is to use a tankless water heater that heats water on demand. Tankless water heaters are known that use resistance heating, and heating via infrared radiation. An exemplary embodiment of an infrared (IR) water heater is described in U.S. Pat. No. 4,510,890 to Cowan, which uses IR radiation to cause combustion of an air/gas mixture that can be used to heat water in a tank. Such a configuration is disadvantageous because the IR radiation is used to combust the mixture, rather than heat the water directly. That leads to inefficiencies, and moreover the combustion of the mixture is a potential danger.

Cowan and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

Another known infrared water heater device is described in EPO patent no. 279767 to Ripka, et al. However, the Ripka heater is disadvantageous as it utilizes a portion of the heat produced as a space heater rather than concentrate the infrared radiation on the piping. U.S. Pat. No. 5,685,997 to LoPresti discusses a plasma oscillator water heater that uses a hollow chamber to heat water outside of the chamber, but such heater is impractical for residential needs, and fails to utilize an infrared light source. Still further devices are described in U.S. pat. pub. no. 2011/0058797 to Servidio (publ. Mar. 2011) and U.S. pat. publ. no. 2012/0080422 to Chung et al. (Publ. Apr. 2012), each of which suffers from one or more disadvantages.

It is also known for a water heater to use the sun as its source of heating energy. For example, U.S. patent appl. no. 2010/0192944 to Gruber discusses a solar water heater and distiller device having multiple lenses arranged on the external wall through which IR radiation can pass. In another design, U.S. Pat. No. 4,334,522 to Dukess discusses a spherical solar energy device through which IR radiation from the sun can pass and be directed onto an inner member's surface. These solar water heaters each suffer from one or more disadvantages including, for example, a dependency upon solar energy and an inefficient use of IR radiation.

Thus, there is still a need for improved water heaters having multiple fluid conduits that are disposed about one or more heating devices.

SUMMARY OF THE INVENTION

The inventive subject matter provides apparatus, systems and methods in which one can heat water using infrared radiation or other heating devices. In especially preferred embodiments, a water heating device can include first and second fluid conduits that are fluidly coupled, where the second fluid conduit can be disposed about at least a portion of the first fluid conduit. A heating device, which preferably comprises an infrared light source, can be disposed between the first and second fluid conduits, such that water flowing within the first and second conduits can be heated by the radiation from the heating device.

In other contemplated embodiments, a water heating device can include a housing having a top, a bottom, and at least one side wall, which collectively define a heating chamber. An infrared light source configured to produce infrared radiation can be disposed within the heating chamber. A coiled conduit can be disposed within the heating chamber at least partially about the first infrared light source such that at least eighty percent, and more preferably ninety percent, of the infrared radiation directly impinges upon the first coiled pipe.

Unless the context dictates the contrary, all ranges set forth herein should be interpreted as being inclusive of their endpoints, and open-ended ranges should be interpreted to include commercially practical values. Similarly, all lists of values should be considered as inclusive of intermediate values unless the context indicates the contrary.

Various objects, features, aspects and advantages of the inventive subject matter will become more apparent from the following detailed description of preferred embodiments, along with the accompanying drawing figures in which like numerals represent like components.

BRIEF DESCRIPTION OF THE DRAWING

FIG. 1A is a front perspective view of one embodiment of a water heating device, FIG. 1B is a vertical cross-section view of the water heater of FIG. 1A.

FIG. 1C is an enlarged view of one embodiment of the conduit and heating device shown in FIG. 1B.

FIG. 1D is an exploded view of FIG. 1B.

FIGS. 2A-2B are side and vertical cross-sectional views, respectively, of another embodiment of a water heater.

FIG. 3 is a side view of an embodiment of a coiled conduit.

FIGS. 4A-4B are a vertical cross-sectional view and a perspective view, respectively, a fluid conduit.

FIGS. 5A-5C are a vertical cross-sectional view, a horizontal cross-sectional view, and a perspective view, respectively, of a conduit having an internal heating device.

FIGS. 6-7 are horizontal cross-sectional views of alternative embodiments of a water heater.

DETAILED DESCRIPTION

One should appreciate that the disclosed techniques provide many advantageous technical effects including reducing the required energy and time necessary to heat water relative to traditional water heaters, while preventing contact of the heating device with water to thereby reduce and preferably eliminate the risk of shortages, as well as fouling, in the water heater.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

In FIGS. 1A-1D, a water heater 100 is shown having an inlet conduit 102 and an outlet conduit 104. The water heater 100 further comprises a housing 106, which preferably covers a heating device within the water heater 100 and prevents unauthorized or unintentional access to the internal components of the water heater 100. Water heater 100 can include a valve 114 configured to regulate the flow of water exiting conduit 104. Any commercially suitable valve could be used including, for example, gate valves, ball valves, solenoid valves, and check valves.

The water heater 100 can optionally include a thermostat 108 and thermometer 110, which can display a temperature of water exiting water heater 100. Of course, it is also contemplated that the temperature at which the water is heated by water heater 100 could be remotely controlled via a wired or wireless network. In some embodiments, the power supplied to the water heater 100 can be varied depending upon the temperature of the water feed through the inlet conduit 102, the flow rate of the water through the water heater 100, and the desired temperature of the water exiting water heater 100.

In some contemplated embodiments, the water feed can comprise water from a city water line. In other embodiments, the water feed can comprise at least some heated water that is recirculated to water heater 100.

Although water heater 100 is shown having a plug 112 capable of receiving a line voltage, it is also contemplated that water heater 100 could receive power from alternative sources including, for example, photovoltaic cells, a natural gas line, a battery, a generator, and any commercially suitable power source(s) and combinations thereof.

Water heater 100 can be sized and dimensioned for various uses including, for example, residential, commercial, and industrial uses. For example, it is contemplated that a water heater for residential uses could be sized and dimensioned such that the housing 106 has a volume of no more than 1 $m^3$. Of course, the specific size and dimension of the water heater 100 will depend upon the amount of water to be heated in a given period of time.

FIG. 1B illustrates a vertical cross-section of the water heater 100 shown in FIG. 1A. Water can enter water heater 100 via inlet conduit 102, which is fluidly coupled to a first fluid conduit 120 where the water can be preheated. Of course, in alternative embodiments, inlet conduit 102 and the first fluid conduit 120 could be a single piece. As shown best in FIG. 1C, the inlet conduit 102 and the first fluid conduit 120 can be coupled, and leaks can be prevented using an O-ring or other seal 122, which is tightened in place via washer 124 and bolt 126, although any commercially suitable fastener(s) could be used.

The first fluid conduit 120 is preferably coupled to a second fluid conduit 132 via junction 136, and the second fluid conduit 132 can be fluidly coupled to outlet conduit 104. In this manner, water can enter the inlet conduit 102 and be preheated, and then be fed through the first fluid conduit 120, junction 136, and the second fluid conduit 132 where the water is further heated before exiting water heater 100 via outlet conduit 104. Of course, it is also contemplated that water could flow through water heater in the opposite direction. In other alternative embodiments, some or all of conduits 120, 132, 136, 102, 104 can be a single piece rather than separate individual components coupled together.

Water heater 100 can include heating device 134, which preferably comprises one or more infrared bulbs or other infrared light sources. Preferred infrared heaters are configured to produce infrared radiation at a wavelength of between 1400 nm to 3300 nm. However, the specific wavelength of the radiation produced can vary, and could even include infrayellow or infrawhite radiation, for example. As shown in FIG. 1C, it is especially preferred that heating device 134 comprises an infrared heating coil that is at least partially disposed about the first fluid conduit 120. The infrared heating coil preferably comprises a stainless steel coil, although other metals, metal composites, and/or commercially suitable material(s) could alternatively be used. In such embodiments, as water flows through the first fluid conduit 120, the water can be heated by the infrared radiation impinging upon the first fluid conduit 120. However, any commercially suitable heating device could be used including, for example, resistance heaters, microwave heaters, and induction heaters.

Heating device 134 is preferably mounted to at least one of the first fluid conduit 120 and inner housing 130 via a ceramic mounting 140, although any commercially suitable material(s) could be used.

It is contemplated that the coiled fluid conduit 132 can include a plurality of stacked pipe segments. It is especially preferred that the spacing between adjacent pipe segments is less than 3 cm, although spacing greater or equal to 3 cm are also contemplated. The coiled fluid conduit 132 preferably comprises copper, although any commercially suitable material(s) could be used including, for example, steel and other metals and metal composites. In especially preferred embodiments, the coiled fluid conduit 132 is disposed about heating device 134 such that at least eighty percent, and more preferably, at least eighty-five percent, of the infrared radiation directly impinges upon the coiled fluid conduit 132. Such an arrangement advantageously allows the conduit 132 to absorb a large amount of heat produced by the heating device 134, such that the water flowing through conduit 132 can quickly be heated without a significant heating delay.

In some contemplated embodiments, the coiled fluid conduit 132 can include first, second, and third conduit segments, and the heating device 134 can include first, second, and third filament segments. In such embodiments, it is especially preferred that the first conduit segment and the first light filament be disposed at substantially the same "level" or height within the inner housing 130. In this manner, radiation emitted by each of the filament segments can be absorbed by the conduit segments.

After flowing through the first fluid conduit 120, water can then pass through the second fluid conduit 132, which preferably comprises a coiled conduit that can be disposed about at least a portion of the heating device 134. As water passes through the second fluid conduit 132, the water can be further heated. The coiled conduit 132 significantly increases the surface area of the conduit 132 exposed to radiation from the heating device 134, and thereby increases the amount of time the water is exposed to heat energy from the heating device 134 while in the water heater 100. It is especially preferred that adjacent coils of the coiled conduit 132 abut one another, such that a primary heat shield can be formed about heating device 134 to thereby trap heat within the volume defined by conduit 132.

Contrary to prior art devices, the heating device 134 can be disposed between the first and second fluid conduits 120, 132, such that the radiation or other heat energy from the heating device 134 can be absorbed by both the first and second fluid conduits 120, 132. This advantageously reduces the required output and energy requirement of the heating device 134 due to the close proximity of both the first and second fluid conduits 120, 132.

It is contemplated in such an arrangement that water entering the water heater 100 at a temperature of about 60° F. (15.6° C.) could be heated to a temperature of about 100-120° F. (37.8-48,9° C.) as it travels through and exits from the water heater 100. This advantageously allows the water to be quickly heated on-demand as it travels through the water heater 100, while using only a fraction of the energy required by conventional water heaters. In some contemplated embodiments, the water heater requires 1 KW of energy or less.

Water heater 100 can further include an inner housing 130 that preferably encloses the first fluid conduit 120, the second fluid conduit 132 and heating device 134. The inner and outer housings 130, 106 can be composed of any commercially-suitable material(s) including, for example, stainless steel and other metals, metal composites, and any combination thereof. As shown in FIG. 1D, water heater 100 can include a top 106A, bottom 106B, and at least one side wall 106C, which can collectively define housing 106.

Thus, water can be initially heated as it travels through the first fluid conduit 120, and can be further heated as it travels through the second fluid conduit 132. In this manner, water received by the water heater 100 could be heated to a temperature of 80° F. (26.67 degree Celsius) or greater when the water exits the water heater 100. Depending upon the specific water temperature required or desired, the flow rate of the water could be increased or decreased as necessary to achieve the desired temperature. In addition, it is contemplated that the water heater 100 could include a second inner housing (not shown) comprising a second heating device and fluids conduit(s), such that the heated water from second fluid conduit 132 can flow into the second inner housing and be further heated by the second heating device. Although the conduits and other components within the second chamber could be arranged identically to those within inner housing 130, it is alternatively contemplated that the second inner housing could comprise a different arrangement and/or have different components than that within the inner housing 130.

It is further contemplated that the water heater 100 could comprise a second heating device (not shown) that is disposed within the inner housing 130. For example, the second heating device could be disposed within or about at least a portion of the first fluid conduit 120, or elsewhere within the inner housing 130. The second heating device could comprise any commercially suitable heating device including, for example, an infrared heater, a resistance heater, and an induction heater.

Water heater 100 can further include a pressure switch or other monitor, such that a pressure within the outlet conduit 104 can be monitored. If the pressure increases above a predetermined threshold, it is contemplated that power or other energy to the water heater 100 could be slut off to prevent risk of an explosion. Although not shown, it is also contemplated that water heater 100 could include a pressure relief valve.

By having water first flow in one direction through inner housing 130 and then flow in the opposite direction, the overall size of the inner housing 130 and the water heater 100 can advantageously be minimized.

Conduits 120 and 132 each preferably comprises copper because of its conductive properties, although any commercially suitable metals or metal composites or other non-insulative material(s) could be used. It is further contemplated that conduits 102, 104 and 136 could comprise stainless steel or any other commercially suitable material (s). In some contemplated embodiments, conduits 102, 104 and 136 could be insulated to prevent heat loss.

In an exemplary embodiment, the heating device 134 could require 4 KW of energy to heat water having an initial temperature of 12° C. and flowing through the water heater 100 at a rate of approximately 70 ml/s to a temperature of approximately 32° C. when the water exits the water heater 100. In such embodiment, it is contemplated that the temperature of the water exiting the water heater 100 could be increased by (a) decreasing the flow rate of the water through the water heater 100, (b) fluidly coupling inner housing 130 to a second inner housing having a second heating device, or (c) adding a second heating device within conduit 120, for example. It is also contemplated that by reducing the flow rate of the water in the above example to approximately 40 ml/s, the temperature of the water exiting the water heater 100 could be increased to approximately 47° C.

FIGS. 2A-2B illustrate another embodiment of a water heater 200. It is contemplated that a temperature of the water at outlet conduit 204 can be between 25° C. to 160° C., and more preferably between 70° C. to 130° C. In this manner, a temperature gradient between the feed water at inlet conduit 202 and the heated water at outlet conduit 204 can be at least 10° C., more preferably, at least 15° C., at least 20° C., and at least 40° C., and still more preferably at least 60° C., and even at least 80° C. With respect to the remaining numerals in each of FIGS. 2A-2B, the same considerations for like components with like numerals of FIG. 1B apply.

In FIG. 3, a coiled conduit 332 is shown having a series of coiled segments 333, which abut adjacent segments to form a primary heat shield. FIGS. 4A-4B illustrates an alternative embodiment of the first fluid conduit 420 having multiple fluid passages 421 within the conduit 420.

FIGS. 5A-5C illustrate a fluid conduit 520 having a second heating device 560 disposed within the fluid conduit 520. The second heating device 560 could be spaced apart from a surface of the conduit 520 via spacers 562. In this manner, water can be exposed to additional heat energy as it flows through the conduit 520. The second heating device 560 preferably comprises an induction heating device, which advantageously reduces the possibility of a short due to water contacting an electrical circuit of the heating device 560. However, it is alternatively contemplated that the second heating device 560 could comprise a resistance heater, an infrared heater, or any other commercially suitable heating device.

In FIG. 6, a horizontal cross-section of another embodiment of a water heater 600 is shown having a housing 630, in which an inner fluid conduit 620 and an outer fluid conduit 632 can be disposed. Although shown having a cylindrical cross-section, housing 630 could comprise any commercially suitable shape such as a square, rectangle, oval, and so forth. The outer fluid conduit 632 can be disposed about at least a portion of the inner fluid conduit 620, and is preferably a coiled conduit to thereby increase the surface area of the conduit exposed to heating device 634.

Heating device 634 is preferably disposed between the inner and outer fluid conduits 620,632, which reduces the distance between the heating element(s) of device 634 and the fluid conduits 620,632 and thereby increases the efficiency of the water heater 600. Although shown as comprising four infrared bulbs 635, it is contemplated that heating device 634 could comprise fewer or a greater number of infrared bulbs depending upon the desired temperature of the water, the rate at which the water is to be heated, the size of the water heater 600, and so forth. Alternatively, heating device 634 could comprise a coiled filament configured to produce infrared radiation, or any other commercially suitable heating element.

The bulbs 635 are preferably configured to produce infrared radiation having a predominant wavelength of between 2500 to 3500 nm and more preferably of between 2700 to 3300 nm. All suitable infrared light sources are contemplated, including especially tubular bulbs, such as the Sylvania® 59934 special stranded LDS Base 3,000 K clear infrared double ended quartz halogen (1200T3Q/IR/CL/HT 144V). Another suitable choice is a Philips® 312678 1,000 watt 235 volt T3 Z Base 2,450K clear reflector industrial infrared quartz halogen (13713Z/98 1000W 235V).

In especially preferred embodiments, the coiled fluid conduit 632 is disposed about the infrared bulbs 635 such that at least eighty percent, and preferably at least eighty-five percent, and more preferably at least ninety percent, of the infrared radiation directly impinges upon the inner and outer fluid conduits 620,632.

FIG. 7 illustrates a horizontal cross-section of yet another embodiment of a water heater 700. Water heater 700 can include a housing 730, in which an inner fluid conduit 720, a heating device 734, and an outer fluid conduit 732 can be disposed. Preferably, the heating device 734 comprises a coiled filament configured to produce infrared radiation and thereby heat the neighboring inner and outer fluid conduits 720,732. By disposing the heating device between the inner and outer fluid conduits 720,732, the fluid conduits are advantageously exposed to nearly all of the infrared radiation produced by the heating device 734.

The outer conduit 732 can comprise a series of parallel conduits disposed about the heating device 734 and substantially parallel to the inner conduit 720, through which water can flow back and forth through the chamber into and out from the page as shown in FIG. 7). In other embodiments, the outer conduit could comprise a coiled conduit such as that shown in FIG. 6.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A water heater, comprising:

a first fluid conduit comprising an elongated, cylindrical piece;

a second fluid conduit fluidly coupled to and disposed about at least a portion of the first conduit, wherein the elongated, cylindrical piece of the first fluid conduit extends along a central axis of the second fluid conduit;

an infrared bulb disposed entirely between the first and second conduits, and configured to heat water flowing within the first and second conduits; and wherein the second conduit comprises a plurality of stacked pipe segments, each of which is disposed to abut adjacent segments of the second conduit such that the plurality of stacked pipe segments collectively form a primary heat shield about the infrared bulb; and wherein the infrared bulb and the second conduit wrap around the first fluid conduit.

2. The water heater of claim 1, wherein the infrared bulb is disposed about at least a second portion of the first conduit.

3. The water heater of claim 2, wherein the second conduit is disposed about at least a portion of the infrared.

4. The water heater of claim 1, wherein the infrared bulb further comprises a ceramic mount configured to couple the infrared bulb to the first fluid conduit.

5. The water heater of claim 1, wherein a temperature of the water at an outlet of the second conduit is at least 15° C. greater than a temperature of the water at an inlet of the first conduit.

6. The water heater of claim 1, further comprising a second heating device at least partially disposed within the first conduit, and spacers disposed within the first conduit and configured to space apart the second heating device from an inner surface of the first conduit.

7. The water heater of claim 1, wherein the second conduit is composed of copper.

8. The water heater of claim 7, wherein the infrared bulb is configured to produce infrared radiation having a frequency of between 2500 to 3500 nm.

9. An infrared water heater, comprising:

a housing having a top, a bottom, and at least one side wall, which collectively define a heating chamber;

a first infrared bulb disposed within the heating chamber, and configured to produce infrared radiation, wherein the first infrared bulb comprises a bulb having first, second, and third segments, and wherein the first segment is adjacent to the second segment which is adjacent to the third segment;

a first coiled conduit disposed within the heating chamber, and at least partially disposed about the first infrared bulb such that at least eighty percent of the infrared radiation directly impinges upon the first coiled conduit, wherein the first coiled conduit comprises first, second, and third stacked pipe segments, and wherein the first stacked pipe segment is adjacent to the second stacked pipe segment which is adjacent to the third stacked pipe segment; and wherein each of the first, second, and third stacked pipe segments is disposed parallel to, and at substantially the same level as, each of the first, second, and third segments, respectively; and a second conduit fluidly coupled to the first coiled conduit, and that extends along a central axis of the first infrared bulb and the first coiled conduit, and wherein the first infrared bulb is disposed between the first coiled conduit and the second conduit.

10. The infrared water heater of claim 9, wherein the first infrared bulb is configured to produce infrared radiation having a frequency of between 2500 to 3500 nm.

11. The infrared water heater of claim 9, wherein the first coiled conduit is disposed within the heating chamber such that at least ninety percent of the infrared radiation directly impinges upon the first coiled conduit.

12. The infrared water heater of claim 9, further comprising a second conduit disposed within the housing and fluidly coupled to the first coiled conduit, and wherein the first infrared bulb is disposed between the first coiled conduit and the second conduit.

13. The infrared water heater of claim 9, wherein the first infrared bulb comprises an infrared bulb.

14. The infrared water heater of claim 9, wherein the first coiled conduit comprises a series of fluidly coupled abutting coil segments that collectively form an inner chamber about at least a portion of the first infrared bulb.

15. The infrared water heater of claim 9, wherein a temperature of the water at an outlet of the first coiled conduit is at least 15° C. greater than a temperature of the water at an inlet of the first coiled conduit.

16. The water heater of claim 1, wherein the second fluid conduit comprises a series of parallel conduits disposed about the infrared bulb, such that the parallel conduits are substantially parallel to the first fluid conduit.

17. A water heater, comprising:

a first fluid conduit comprising an elongated cylindrical pipe;

a second fluid conduit fluidly coupled to and disposed around the elongated cylindrical pipe, such that the elongated cylindrical pipe of the first conduit extends along a central axis of the second fluid conduit;

a coiled heating device disposed entirely between the first and second conduits, and having stacked segments that parallel the second fluid conduit, and wrap around the first fluid conduit, wherein the coiled heating device generates infrared light to heat water flowing within the first and second conduits; and wherein the second conduit comprises a plurality of stacked pipe segments, each of which is disposed to abut adjacent segments of the second conduit such that the plurality of stacked pipe segments collectively form a primary heat shield about the heating device.

* * * * *